US005129799A

United States Patent [19]

Scheldorf

[11] Patent Number: 5,129,799

[45] Date of Patent: Jul. 14, 1992

[54] TORSIONAL VANE SPRING

[75] Inventor: Gary O. Scheldorf, Louisville, Ky.

[73] Assignee: General Electric Company, Louisville, Ky.

[21] Appl. No.: 756,525

[22] Filed: Sep. 9, 1991

[51] Int. Cl.[5] ..... F04C 18/356

[52] U.S. Cl. ..... 418/63; 418/248; 267/154; 267/180

[58] Field of Search ..... 418/63, 65, 248; 267/154, 180

[56] References Cited

U.S. PATENT DOCUMENTS

| | | | |
|---|---|---|---|
| 3,532,448 | 10/1970 | Rinehart | 418/63 |
| 3,743,454 | 7/1973 | Rinehart | 418/248 |
| 4,605,362 | 8/1986 | Sturgeon et al. | 418/63 |
| 4,664,608 | 5/1987 | Adams et al. | 418/63 |
| 4,960,372 | 10/1990 | Scheldorf et al. | 418/63 |

FOREIGN PATENT DOCUMENTS

| | | | |
|---|---|---|---|
| 61-66885 | 4/1986 | Japan | 418/63 |
| 62-91684 | 4/1987 | Japan | 418/63 |

*Primary Examiner*—John J. Vrablik

*Attorney, Agent, or Firm*—Radford M. Reams; H. Neil Houser

[57] ABSTRACT

A rotary compressor comprising a cylindrical chamber, a vane slidably mounted in the peripheral cylinder wall and a torsion spring to bias the vane into contact with an eccentrically mounted roller. The spring includes an elongated central portion and a pair of arms extending from the central portion in parallel planes. The arms are curved or radiused in opposite directions. The central portion is connected to the outer edge of the vane while the ends of the arms are connected to opposite side of the cylinder so that the arms exert a torsional force on the central portion.

7 Claims, 2 Drawing Sheets

TORSIONAL VANE SPRING

BACKGROUND OF THE INVENTION

A well known type of hermetically sealed rotary compressors for use in refrigeration systems includes a hermetically sealed casing containing a compressor comprising a cylindrical wall and a pair of opposed end walls or plates defining a compression chamber. A roller is eccentrically mounted within the chamber and a vane is slidably mounted in a vane slot extending radially outward from the chamber within the cylindrical wall. The inner radial edge of the vane engages the periphery of the roller to divide the chamber into a low pressure side and a high pressure side. The vane is biased against the periphery of the roller by a spring. In operation of the compressor, rotation of the roller draws gas refrigerant into the low pressure side of the chamber and discharges compressed gas refrigerant from the high pressure side of the chamber.

Currently employed springs have proven satisfactory when used with relatively small displacement compressors as the spring is required to move through only a relatively short distance as the vane moves between the top-dead-center and bottom-dead-center positions of the roller. However, in larger displacement (volume) compressors the vane must move through a larger stroke distance and the spring thus is flexed to a greater degree. This places greater stress on the spring material. To some extent this may be compensated for by use of heavier spring materials; however, that increases the spring pressure on the vane and may adversely effects the operation. In addition, additional spring material would increase the cost of each compressor.

A primary object of this invention is to provide a rotary compressor including an improved vane biasing arrangement which is inexpensive and provides the needed biasing force without undue stress on the spring.

SUMMARY OF THE INVENTION

In accordance with one embodiment of the invention a rotary compressor includes a cylindrical wall and a pair of end walls defining a compression chamber. A roller is eccentrically rotatable within the chamber. A vane is slidably mounted in a radial vane slot in the cylindrical wall and a torsion spring continually urges the vane into engagement with the roller. The spring has an elongated central section with an arcuate arm extending from each of its ends. Each arm is curved in a direction opposite to the curvature of the other arm, lies in a plane parallel to the plane of the other arm and each arm has a distal end. The torsion spring is mounted about the cylindrical wall with the central spring section received in an elongated slot or recess formed in the outer edge of the vane and with the distal ends of the spring arms engaging the cylinder wall in the area generally opposite the vane slot. As the vane moves outwardly of the cylindrical wall, the spring arms exert a torsion force on the central portion of the spring and thereby reduce the stress in the arms.

DESCRIPTION OF THE PREFERRED EMBODIMENTS

Figure 1:
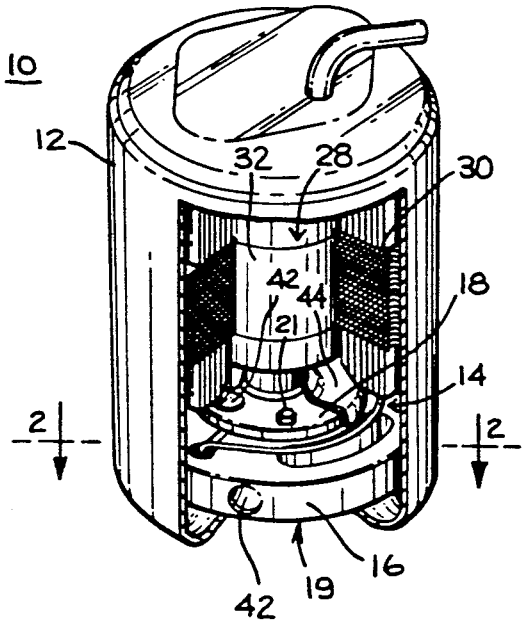
FIG. 1 is a perspective view of a rotary compressor, partly broken away and partly in section.
Figure 2:
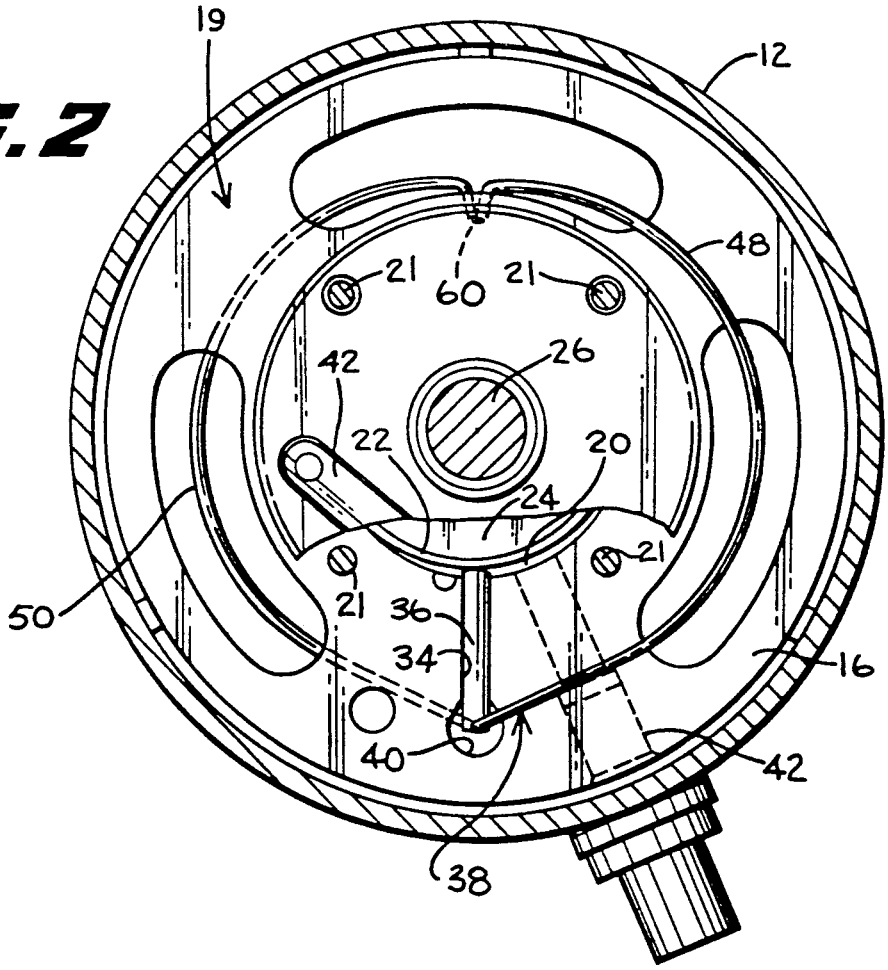
FIG. 2 is a cross-sectional view generally as seen along line 2—2 in FIG. 1.

Referring to FIGS. 1 and 2, there is illustrated a rotary compressor incorporating one embodiment of the present invention. The compressor 10 includes a hermetically sealed casing 12 in which there is disposed a compressor unit 14. The unit 14 includes a cylindrical wall 16, a top wall 18 and an opposed bottom wall, not shown, forming a cylinder 19 defining an annular compression chamber 20. Bolts, such as those shown at 21, join the walls into an unitary hermetic assembly. A roller 22 is disposed for rotation in the chamber 20 and driven by an eccentric 24 formed as an integral part of a shaft 26 extending downwardly from a motor 28, having a stator 30 and a rotor 32.

As best seen in FIG. 2, the cylindrical wall 16 is provided with a radially extending vane slot 34 in which a vane 36 is slidably mounted. The vane 36 is biased inwardly of the wall 16 by a spring 38 so that the radially inner end of the vane engages the outer periphery of the roller 22, thereby dividing the chamber into a high pressure side and a low pressure side. The radially outer end of the vane 36 is received in an opening 40 formed in the cylindrical wall 16 so as to be exposed to the interior of the casing 12. Conveniently the vane slot 34 is "key hole" shaped and the opening 40 is the enlarged outer end of the vane slot.

As the motor rotor 32 is rotated it causes the eccentric 24 and roller 22 to rotate within the chamber 20. This draws low pressure refrigerant gas through an inlet conduit 42 in the wall 16 into the low pressure side of the chamber 20. An outlet opening for the chamber 20, not shown, is controlled by valve 42. The valve is normally closed and opens in response to a predetermined high pressure of the refrigerant in the chamber 20. Thus, when roller 22 has compressed the gas in the high side of chamber to the appropriate pressure, valve 42 opens and the high pressure, compressed refrigerant gas is released into the casing 12. A cover or baffle 44 is mounted over the top wall and forms a muffling chamber or muffler to attenuate the noise generated by the gas exiting through the outlet opening and valve 42.

Rotary compressors of this general type are well known and further details of one such compressor construction are set forth in U.S. Pat. No. 4,664,608, for ROTARY COMPRESSOR WITH REDUCED FRICTION BETWEEN VANE AND VANE SLOT, issued on May 12, 1987 and assigned to General Electric Company; which patent is incorporated herein by reference.

With low volume compressors, the roller is almost as large in diameter as the compression chamber and the vane travels only a short distance back and forth in the vane slot as the roller rotates within the chamber. However, a normal way of increasing the capacity of a compressor is to increase the difference in diameter between the chamber and the roller. This causes the vane to move longer distances in the vane slot and to exert greater flexing forces on the vane spring. The present invention substantially reduces the adverse effects of such flexing of the vane spring.

Figure 3:
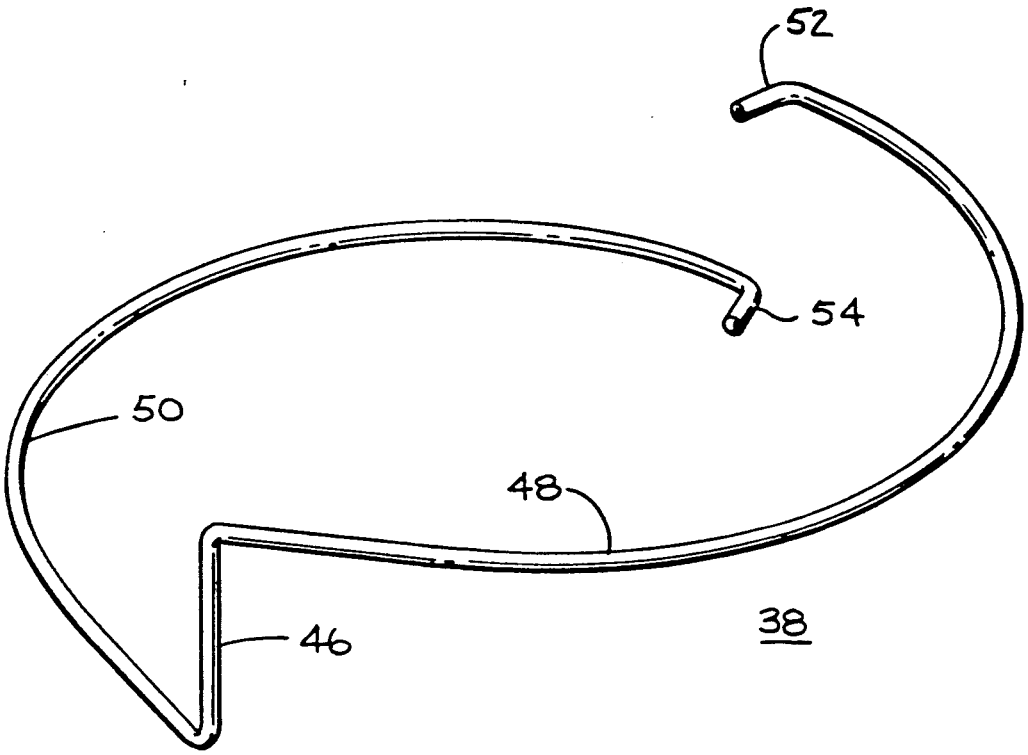
FIG. 3 is a perspective view of the vane spring employed in the compressor illustrated in FIG. 1.

Referring particularly to FIGS. 2 and 3, the vane spring 38 includes an elongated central section 46 with arms 48 and 50 respectively extending from its ends. Each arm is smoothly curved and preferably has a large portion of its length formed as the radius of a circle. The direction of curvature of each arm is opposite to the direction of curvature of the other arm. For example, as viewed in FIG. 3, arm 48 curves in a counterclockwise manner while arm 50 curves in a clockwise manner. The arms lie in planes which are perpendicular to the axis of elongated central section 46 and which are parallel to each other. The distal ends of the arms are formed with tangs 52 and 54, which are return bent to extend generally toward the central section 46.

Figure 4:
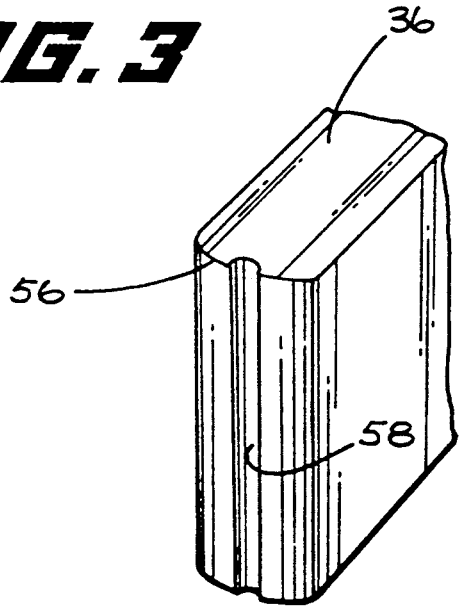
FIG. 4 is an enlarged, fragmentary perspective view illustrating the exterior end of the vane employed in the compressor illustrated in FIG. 1.
Figure 5:
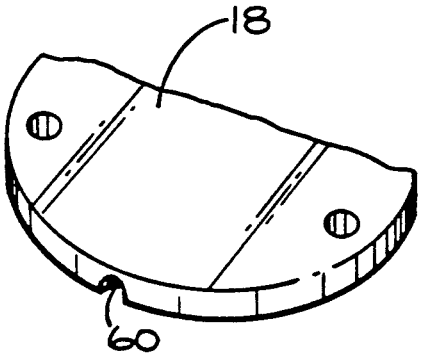
FIG. 5 is an enlarged fragmentary view of a portion of one of the end plates incorporated in the compressor illustrated in FIG. 1.

In the illustrative embodiment, the spring 38 is mounted about the cylindrical wall 16 with the central spring section 46 engaging the end of vane 36 and with the distal ends 52 and 54 of the spring arms engaging a portion of the cylinder 19 generally opposite the vane slot 34. Referring more particularly to FIG. 4, the radially outer end 56 of the vane 36 is formed with an elongated slot or recess 58 which extends between the top and bottom of the vane. The elongated central section 46 of the spring is mounted in the slot 58 in the vane. The tangs 52 and 54 are used to mount or attach the spring to the cylinder generally opposite the vane. Referring to FIG. 5, each of the plates forming the bottom wall and the top wall 18 is formed with a recess formed in the surface of the plate abutting the cylindrical wall and extending inwardly from the outer periphery of the top or bottom wall respectively, as shown generally at 60. The recesses 60 preferably are widest at the outer edge of the wall and narrow as they proceed into the plate. Each of the tangs 52 and 54 is received in a corresponding one of the recesses 60. As the vane 36 moves outwardly in the slot 36 the arms 48 and 50 are stretched and placed under tension. They in turn tend to transfer this force to the spring central section 46 by exerting a torsional (or twisting) force on the central section. This relieves the stress in the arms so the spring can be constructed from appropriate sized material and still operate well within its stress limits.

It will be understood that recesses could be drilled or otherwise formed in the outer surface of cylindrical wall 16 to receive the tangs 52 and 54; however, forming them in the surfaces of the top and bottom walls engaging the cylindrical wall provides manufacturing economies. Also, slanting the sides of the recesses prevents the tangs from being bent out of shape during operation. However, if desired, cylindrical openings of appropriate size could be drilled in the walls to receive the tangs. If desired, the orientation of the spring can be reversed. That is, the central section 46 could be mounted to the cylinder 19 at a position generally opposite the vane and the tangs could be attached to the vane.

The embodiments described herein are presently considered to be preferred. In accordance with the patent statutes, changes may be made in the disclosed embodiments and the manner in which they are used without departing from the true spirit and scope of the invention.

What is claimed is:

1. A rotary compressor comprising:

a cylindrical wall and a pair of end walls defining a cylinder;

a roller eccentrically rotatable within said cylinder;

said cylindrical wall having a radial slot therein, a vane slidably mounted in said slot for engagement with the periphery of said roller;

a torsional spring for continuously urging said vane toward said roller;

said spring including an elongated central section having a pair of radiused arms extending from the opposite ends thereof;

each of said arms being curved in a direction opposite to the curve of the other of said arms and lying in a plane parallel to the plane of the other of said arms;

each of said radiused arms including a distal end formed as an engagement means;

said torsional spring being mounted about said cylinder with one of said central section of said spring and said engagement means engaging the outer edge of said vane and with the other of said central section of said spring and said engagement means engaging said cylinder opposite said slot; whereby movement of said vane outwardly in said slot causes said radiused arms to exert a torsional force on said central section.

2. A rotary compressor as set forth in claim 1, wherein: said outer edge of said vane defines an elongated slot extending parallel to the axis of said cylinder and said central section of said torsion spring is received in said slot in said vane outer edge.

3. A compressor as set forth in claim 1, wherein: the outer surface of said cylinder opposite said slot is formed with at least one recess and said distal ends of said radiused arms are received in said at least one recess.

4. A compressor as set forth in claim 3, wherein: at least one of said end walls is formed with a slot abutting said cylindrical wall to form said at least one recess.

5. A rotary compressor comprising:

a cylindrical wall and a pair of end walls defining a cylinder;

a rotor eccentrically rotatable within said cylinder;

said cylindrical wall having a radial slot therein, a vane slidably mounted in said radial slot for engagement with the periphery of said rotor, said vane including an outer edge having an elongated recess extending parallel to the axis of said cylinder, the portion of said cylinder generally opposite said radial slot having at least one recess therein;

a torsional spring for continuously urging said vane toward said rotor;

said spring including an elongated central section received in said elongated recess in said vane and having a pair of radiused arms extending from the opposite ends thereof;

each of said radiused arms being curved in a direction opposite to the curve of the other of said arms, lying in a plane parallel to the plane of the other of said arms and overlying a corresponding one of said end walls;

each of said radiused arms including a distal end received in said at least one recess in said portion of said cylinder generally opposite said radial slot;

whereby movement of said vane outwardly in said slot causes said radiused arms to exert a torsional force on said central section.

6. A compressor as set forth in claim 5, wherein: said at least one recess in said cylinder comprises a pair of spaced apart generally cylindrical recesses projecting into said cylinder and each of said distal end of each of said spring arms is formed as a tang received in a corresponding one of said cylindrical wall recesses.

7. A compressor as set forth in claim 6, wherein: each of said end walls is formed with a slot abutting said cylindrical wall to form corresponding ones of said recesses.

* * * * *